US009440432B2

(12) United States Patent
Yamanobe

(10) Patent No.: US 9,440,432 B2
(45) Date of Patent: Sep. 13, 2016

(54) IMAGE RECORDING DEVICE

(71) Applicant: FUJIFILM CORPORATION, Minato-ku, Tokyo (JP)

(72) Inventor: Jun Yamanobe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/072,358

(22) Filed: Mar. 17, 2016

(65) Prior Publication Data

US 2016/0193829 A1 Jul. 7, 2016

Related U.S. Application Data

(63) Continuation of application No. PCT/JP2014/067076, filed on Jun. 26, 2014.

(30) Foreign Application Priority Data

Sep. 20, 2013 (JP) ..... 2013-195473
Jun. 25, 2014 (JP) ..... 2014-130518

(51) Int. Cl.
*B41J 2/045* (2006.01)
*B41J 2/21* (2006.01)
*B41J 2/07* (2006.01)

(52) U.S. Cl.
CPC ..... *B41J 2/0451* (2013.01); *B41J 2/04506* (2013.01); *B41J 2/04508* (2013.01); *B41J 2/2121* (2013.01); *B41J 2/07* (2013.01)

(58) Field of Classification Search
None
See application file for complete search history.

(56) References Cited

U.S. PATENT DOCUMENTS 6,359,701 B1 * 3/2002 Yamada ..... B41J 2/5056 347/14
2008/0211850 A1 9/2008 Miyamoto et al.

FOREIGN PATENT DOCUMENTS

JP H8-174805 A 7/1996
JP 2008-74061 A 4/2008
JP 2008-168592 A 7/2008
JP 2009-18504 A 1/2009
JP 2010-685 A 1/2010

OTHER PUBLICATIONS

International Search Report issued in International Application No. PCT/JP2014/067076 on Oct. 7, 2014.
Written Opinion of the ISA issued in International Application No. PCT/JP2014/067076 on Oct. 7, 2014.

* cited by examiner

*Primary Examiner* — Lisa M Solomon
(74) *Attorney, Agent, or Firm* — SOLARIS Intellectual Property Group, PLLC

(57) ABSTRACT

In an image recording device, in a case where a J-th nozzle (H2 [3]) of a certain image recording head (H2) among plural image recording heads (H1, H2) is in a discharge defect state, a dot size of an image recording droplet discharged from a J-th nozzle (H1 [3]) of an image recording head (H1) other than the image recording head (H2) is changed to a size within dot sizes used in normal image recording in a high-speed image recording mode, which is larger than a dot size of an image recording droplet to be discharged from the discharging nozzle (H2 [3]). In a low-speed image recording mode, the dot size of the image recording droplet discharged from the discharging nozzle (H1 [3]) is changed to a size which is larger than the largest dot size among dot sizes used in the normal image recording.

5 Claims, 17 Drawing Sheets

IMAGE RECORDING DEVICE

CROSS-REFERENCE TO RELATED APPLICATIONS

This application is a continuation application of International Application No. PCT/JP2014/067076, filed Jun. 26, 2014, the disclosure of which is incorporated herein by reference in its entirety. Further, this application claims priority from Japanese Patent Application No. 2013-195473 filed Sep. 20, 2013, and Japanese Patent Application No. 2014-130518 filed Jun. 25, 2014, the disclosures of which are incorporated herein by reference in their entireties.

BACKGROUND OF THE INVENTION

1. Field of the Invention

The present invention relates to an image recording device.

2. Description of the Related Art

In an ink jet type image recording device, if a discharge defect such as shifting of impact positions of droplets discharged from each nozzle, variation in sizes of droplets, or non-discharge of droplets occurs, the discharge defect may be visually recognized as streaky irregularities. Although such a discharge defect occurs, a technique of adjusting (correcting) sizes of droplets in the vicinity of the discharge defect so that the discharge defect is not visually recognized has been proposed.

For example, there is a technique of reducing visibility of streaky irregularities by correcting sizes of droplets on both sides of a non-discharging nozzle to being larger (see JP2008-168592A).

SUMMARY OF THE INVENTION

However, in a case of a technique in which droplets of two or more sizes are discharged, a discharge frequency of a droplet of a maximum size obtained by increasing the size of the droplet is the same as a discharge frequency of its head. Accordingly, in the technique of reducing visibility of streaky irregularities by increasing sizes of droplets on both sides of a non-discharging nozzle to become larger than a normal size, a printing speed becomes slow.

Accordingly, a main object of the invention is to provide an image recording device capable of selecting a printing speed and image quality (reduction in visibility of streaky irregularities due to correction).

According to a preferred aspect of the invention, there is provided an image recording device including: an image recording unit that includes a plurality of image recording heads in which each head includes the same number of a plurality of discharging nozzles that discharge an image recording droplet; an image processing unit that converts an input image into dot data configured by dots of two or more sizes; a data transmitting unit that transmits the dot data from the image processing unit to the image recording unit; an image recording mode control unit that controls the image recording unit so that an image is recorded in at least two image recording modes where image recording speeds are different from each other; a discharge state reading unit that reads discharge states of the plurality of discharging nozzles; and a dot data change unit that changes, when the discharge state reading unit detects a discharge defect of a first discharging nozzle which is a J-th discharging nozzle among the plurality of discharging nozzles of one image recording head among the plurality of image recording heads, a dot size of an image recording droplet discharged from a second discharging nozzle which is a J-th discharging nozzle of at least one image recording head other than the image recording head including the first discharging nozzle to a first size larger than a dot size of an original image recording droplet to be discharged from the first discharging nozzle in a case where an image is recorded in a first mode where an image recording speed is fast among the image recording modes, and changes the dot size of the image recording droplet discharged from the second discharging nozzle to a second size which is larger than the largest dot size among the dot sizes in a case where the image is recorded in a second mode where the image recording speed is slower than that in the first mode among the image recording modes.

According to the invention, it is possible to provide an image recording device capable of selecting a printing speed and image quality (reduction in visibility of streaky irregularities due to correction).

DESCRIPTION OF THE PREFERRED EMBODIMENTS

Figure 1:
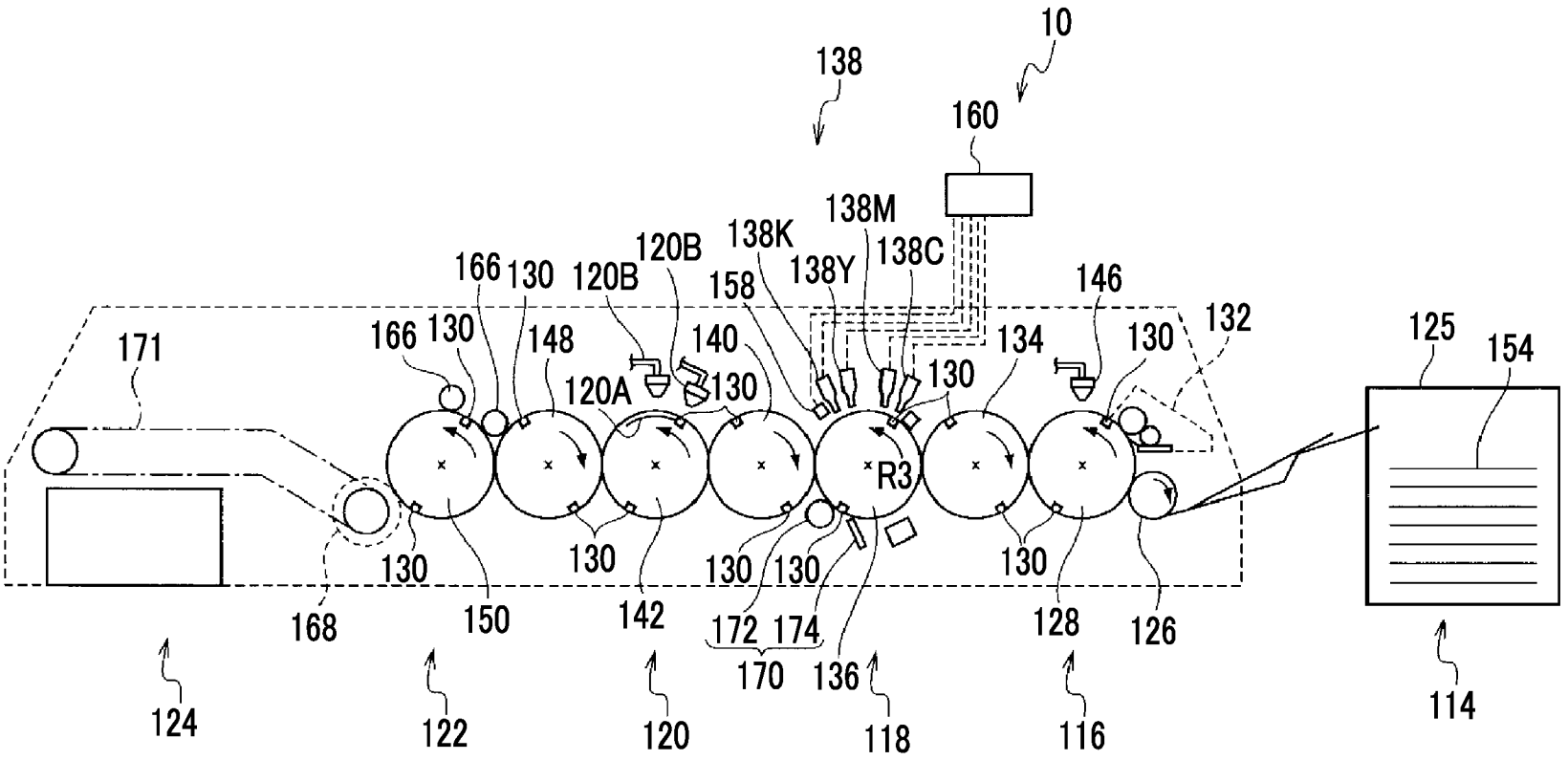
FIG. 1 is a schematic configuration diagram illustrating a basic configuration of an image recording device according to a preferable embodiment of the invention.

Hereinafter, preferable embodiments of the invention will be described with reference to the accompanying drawings.

First, an image recording device 10 of an ink jet recording type according to a preferable embodiment of the invention will be described with reference to FIG. 1. The image recording device 10 includes a sheet feeding unit 114, a process liquid coating unit 116, an image recording unit 118, a dryer 120, a fixing unit 122, and a sheet discharge unit 124.

The image recording device 10 is a device that records an output image onto a sheet 154 which is an example of a recording medium while sequentially transporting the sheet 154 (see FIG. 2, or the like) from the sheet feeding unit 114 to respective portions of the process liquid coating unit 116, or the like.

The sheet feeding unit 114 is configured so that the sheets 154 are stacked in a sheet feeding tray 125 and the sheet 154 is fed one by one. The fed sheet 154 is transported to the process liquid coating unit 116 through a sheet feeding drum 126.

As the sheets 154, plural types of sheets of different sheet types or different sizes (medium sizes) may be used. Hereinafter, as the sheets 154, an example in which flat sheets (cut sheets) are used will be described.

A process liquid coating unit drum 128 is disposed to be rotatable in the process liquid coating unit 116. As the process liquid coating drum 128 rotates in a state where a tip of the sheet 154 is held by a holding member 130 (gripper) of a claw shape provided in the process liquid coating drum 128, the sheet 154 is transported to a downstream side. Further, a process liquid is coated on the sheet 154 by a process liquid coating device 132 disposed above the process liquid coating drum 128.

The process liquid coated on the sheet 154 by the process liquid coating unit 116 includes a component that condenses or thickens coloring materials (pigments or dyes) in an ink provided to the sheet 154 by the image recording unit 118. As the process liquid is in contact with the ink, separation between the coloring materials and a solvent in the ink is prompted.

As a method of providing the process liquid, droplet hitting based on process liquid discharge, coating using on a roller, general coating using a sprayer, or the like may be used.

The process liquid coating unit 116 includes a process liquid dryer 146 at a position that faces an outer circumferential surface of the process liquid coating drum 128. The process liquid dryer 146 dries a solvent component in the process liquid provided onto the sheet 154. Thus, it is possible to suppress floating (a phenomenon that a pixel based on an ink drop is not recorded at a desired position due to floating of the ink drop on the process liquid) of the coloring materials.

Then, the sheet 154 is transported to the image recording unit 118 through the transport drum 134. In the image recording unit 118, while the sheet 154 is being transported in a state of being held by a image recording drum 136, ink drops discharged from discharging nozzles of ink jet type image recording heads 138 disposed above the image recording drum 136 are attached thereto, so that an image is recorded on the surface of the sheet 154. The image recording drum 136 is configured to be rotated in an arrow R3 direction by a motor or the like, and also serves as relative movement means in this invention.

In this embodiment, ink jet image recording units 138K, 138Y, 138M, and 138C of four colors of K (black), Y (yellow), M (magenta), and C (cyan) which are fundamental colors are disposed along a circumferential direction of the image recording drum 136. Each of the ink jet image recording units 138K, 138Y, 138M, and 138C includes so-called plural in line heads having an ink discharge range corresponding to a maximum width of the sheet 154.

Particularly, in this embodiment, as described above, since the process liquid to be transported with the coloring materials in the ink is provided onto the sheet 154 in advance by the process liquid coating unit 116, the coloring materials in the ink are condensed (or thickened), to thereby make it possible to suppress blurring.

Figure 2:
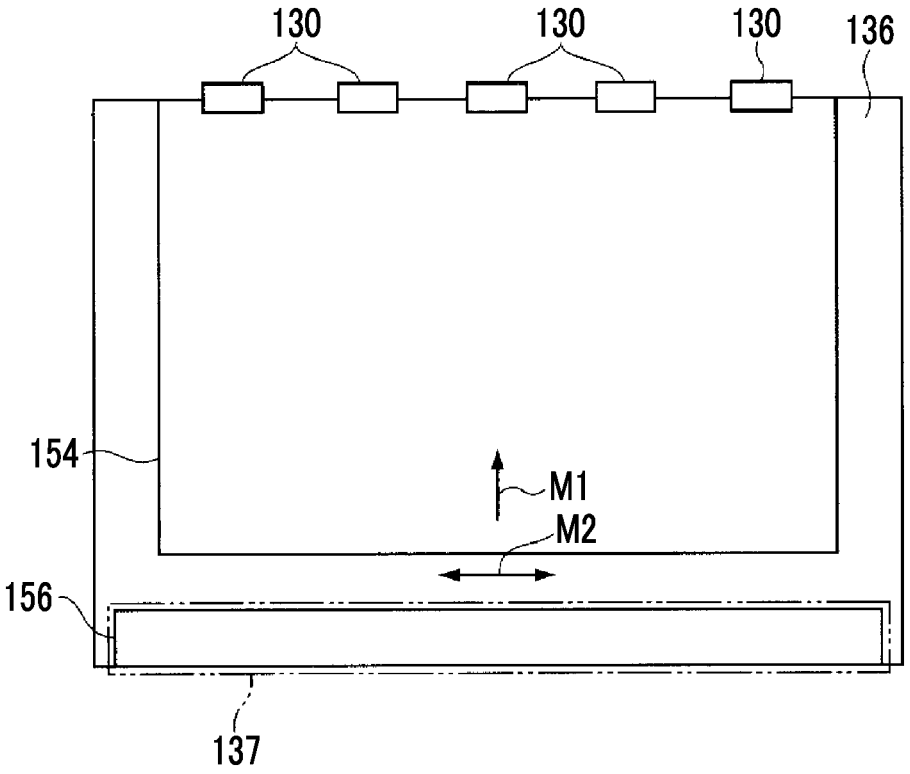
FIG. 2 is a schematic diagram illustrating a state where an image recording drum of an image recording device according to a preferable embodiment of the invention is developed.

FIG. 2 shows a state where the surface of the image recording drum 136 is developed in the circumferential direction in the image recording device 10 according to the preferable embodiment of the invention.

As shown in FIG. 2, in the image recording drum 136 of the image recording unit 118, a check image recording region 137 is set in a portion where the held sheet 154 is not present (on a rear side in a transport direction (indicated by an arrow MD with reference to the sheet 154 in the example of FIG. 2). Further, in the check image recording region 137, as described later in detail, in the image recording drum 136, ink drops are discharged from the respective heads of the ink jet image recording units 138Y, 138M, 138C, and 138K in predetermined patterns at predetermined timings, so that a check image (check pattern) 156 (which will be describe later) is recorded.

In FIG. 1, in one image recording drum 136, a structure in which two sheets 154 can be provided for one turn (double-sheet-size drum) is shown, but a structure in which only one sheet 154 can be provided (single-sheet-size drum, see FIG. 2), a structure in which three sheets can be provided (triple-sheet-size drum, not shown), or a structure in which four or more sheets can be provided may be used.

As shown in FIG. 1, the image recording unit 118 further includes a check image reading sensor 158. The check image 156 recorded in the check image recording region 137 of the image recording drum 136 by each head of the ink jet image recording units 138Y, 138M, 138C, and 138K is read by the check image reading sensor 158. The check image reading sensor 158 is configured to read the shape or tone of the check image, bleeding or blurring of the ink, or the like. A CCD line sensor or the like may be used as the reading sensor.

The read data is sent to the control device 160, and a nozzle state (for example, bending in the ink discharge direction, non-discharge, or the like) is detected. Further, a nozzle in which a value of the detected state is lower than a predetermined threshold value is extracted as a discharge defect nozzle, and the control device 160 corrects an output image in a procedure to be described later so that the influence of the discharge defect nozzle is reduced (preferably, so that the discharge defect is not detected as streaky irregularities).

The image recording unit 118 further includes a check image removal member 170. The check image removal member 170 performs a removal process for removing the check image 156 shown in FIG. 2 recorded on the image recording drum 136 from the image recording drum 136.

In this embodiment, the check image removal member 170 includes a cleaning liquid coating roller 172 and an ink removal blade 174.

The cleaning liquid coating roller 172 transfers and coats a cleaning liquid supplied from a cleaning liquid supply unit (not shown) onto the surface of the image recording drum 136.

The ink removal blade 174 is formed of an elastic material such as rubber and has a plate shape having a width which is at least equal to or greater than the width of the check image 156. If the ink removal blade 174 is pressurized on the circumferential surface of the image recording drum 136, the ink which is the record of the check image 156 is raked.

An ink detection sensor 175 that detects the degree of the remaining ink on the image recording drum 136 after the removal of the check image 156 is performed by the check image removal member 170 may be provided.

In the above-described example, an aspect in which the check image 156 is recorded on the image recording drum 136 is shown, but the check image 156 may be recorded on a non-image recording unit (for example, an end portion of the recording medium) of the sheet 154.

The sheet 154 on which the image is recorded by the image recording unit 118 is sent to the dryer 120 through the transport drum 140. In the dryer 120, while the sheet 154 is being held and transported by a dryer drum 142, a solvent (moisture) in the ink is dried.

In this embodiment, the dryer 120 includes first drying means 120A that is provided inside the dryer drum 142 and dries the solvent from an opposite side of the image recorded surface of the sheet 154, and second drying means 120B that is provided outside the dryer drum 142 and dries the solvent from the image recorded surface of the sheet 154. Specifically, as the first dryer means 120A, a configuration in which a heating member is pressed against the sheet 154 from the opposite side of the image recorded surface of the sheet 154 and heat is supplied by contact thermal conduction may be used, for example. As the second dryer means 120B, a configuration in which hot air is flown to the sheet 154 from the image recorded surface side of the sheet 154 may be used. Further, the second dryer means 120B may have a configuration in which the sheet 154 is dried by radiation of heat from a carbon heater, a halogen heater, or the like, in addition to hot air supply.

The sheet 154 of which the solvent (moisture) in the ink is dried by the dryer 120 is sent to the fixing unit 122 through the transport drum 148. In the fixing unit 122, an image (ink) is fixed by heating and pressure welding using the fixing roller 166. Specifically, for example, by brining the fixing roller 166 into contact with the surface of the sheet 154 at a temperature of about 75° C. and a pressure of about 0.3 MPa, polymer resin particles (latex) included in the ink are melted, and thus, adhesion with respect to the sheet 154 is increased.

The sheet 154 on which the image is recorded in this way is transported from the discharge roller 168 by a discharge belt 171, and discharged from the image recording device 10 through the sheet discharge unit 124. In the sheet discharge unit 124, plural sheets 154 are accumulated.

Figure 3A:
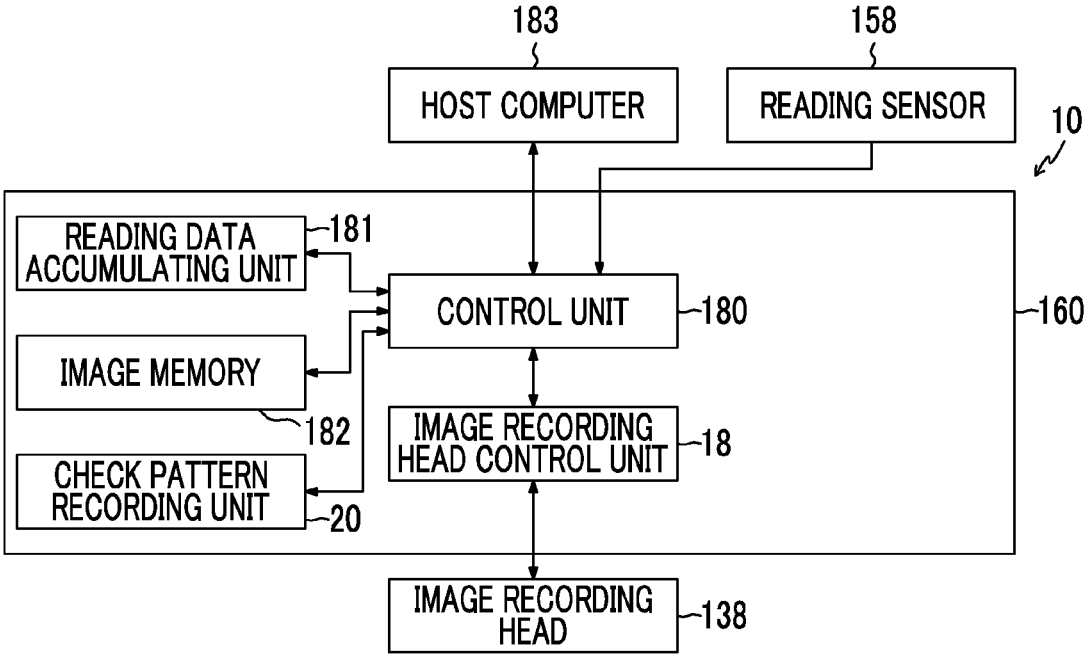
FIG. 3A is a block diagram illustrating a basic configuration of a control device in an image recording device according to a preferable embodiment of the invention.

As shown in FIG. 3A, the image recording device 10 includes the control device 160 that controls the image recording device 10.

The control device 160 includes a control unit 180 that includes a central processing unit (CPU), a read only memory (ROM), and a random access memory (RAM) and executes a processing program of the image recording device 10, an image recording head control unit 18 that controls each head of the image recording heads 138, a check pattern recording unit 20 that stores check pattern information, an image memory 182 that stores image data or the like, and a reading data accumulating unit 181 that stores check pattern data which is read. The processing program is stored in the ROM which is a recording medium.

A host computer 183 that performs input and output of information relating to a printing job, the image recording heads 138 that are controlled by the image recording head control unit 18 to print an output image, and the check image reading sensor 158 that reads a check pattern recorded by the image recording heads 138 are connected to the control device 160.

Figure 3B:
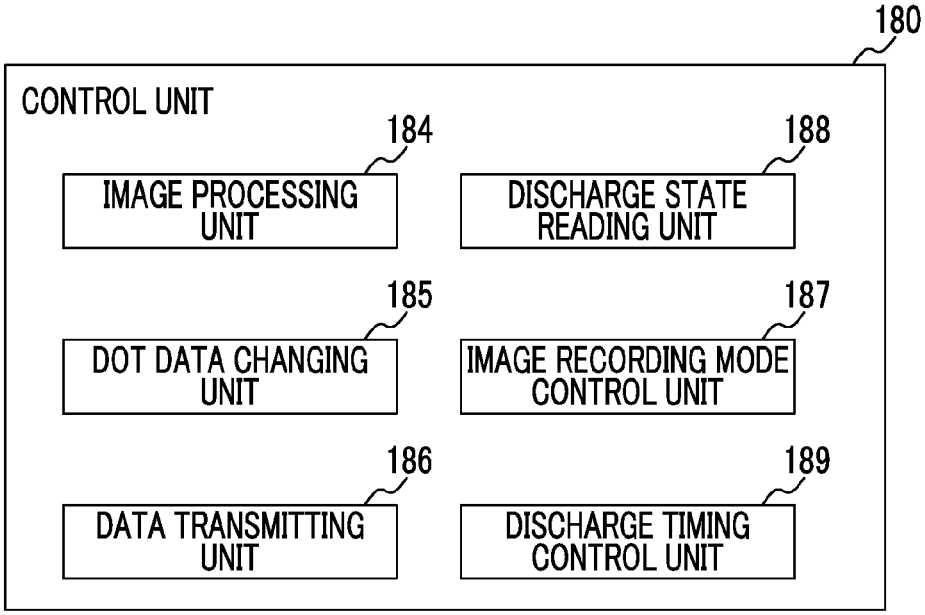
FIG. 3B is a block diagram illustrating a control unit of the control device.

As shown in FIG. 3B, the control unit 180 includes an image processing unit 184, a dot data changing unit 185, a data transmitting unit 186, an image recording mode control unit 187, a discharge state reading unit 188, and a discharge timing control unit 189. The image processing unit 184 converts an input image or the like into dot data configured by dots of two or more sizes. The data transmitting unit 186 transmits the dot data to each head of the image recording heads 138 from the image processing unit. The image recording mode control unit 187 controls at least two image recording modes of a high-speed image recording mode (a first mode) and a low-speed image recording mode (a second mode). The discharge state reading unit 188 reads a discharge state of a discharging nozzle of each head of the image recording heads 138 based on data from the check image reading sensor 158. When the discharge state reading unit 188 detects a discharge defect nozzle, the dot data changing unit 185 changes the dot data sent to each head of the image recording heads 138. The discharge timing control unit 189 controls a timing when the discharging nozzle of each head of the image recording heads 138 discharges an image recording droplet.

The image recording heads 138 include the ink jet image recording units 138K, 138Y, 138M, 138C of four colors of K (black), Y (yellow), M (magenta), and C (cyan) which are fundamental colors. The ink jet image recording units 138K, 138Y, 138M, 138C are provided along the circumferential direction of the image recording drum 136 (see FIG. 1). Since the ink jet image recording units 138K, 138Y, 138M, and 138C have the same configuration, an ink jet image recording unit 138A having the common configuration in which "A" represents signs (K, C, M, Y) that mean color codes will be described hereinafter.

The ink jet image recording unit 138A includes plural (N) recording heads with respect to each color of K, C, M, and Y. Each of the plural recording heads includes the same number (M) of discharging nozzles that discharge an image recording droplet.

The image recording device 10 of this embodiment employs a configuration in which a droplet of any one dot size among droplets of two or more sizes is discharged from the discharging nozzles of the recording head or a droplet is not discharged.

More specifically, as the droplets, for example, three types of droplets of a small droplet, a medium droplet, and a large droplet are employed. That is, if a state where a droplet is not discharged is included, each pixel shows four-valued data. The droplets are referred to as Dot-1, Dot-2, . . . , Dot-D in an ascending order of droplet sizes. In this example, since the small droplet and the medium droplet are used, D=2. Further, the large droplet is denoted as Dot-Da.

In normal image recording, it is assumed that an image is recorded from three patterns of a non-droplet, the small droplet (Dot-1) and the medium droplet (Dot-2), and that the large droplet is only used in a case where a discharge defect is corrected.

Figure 4:
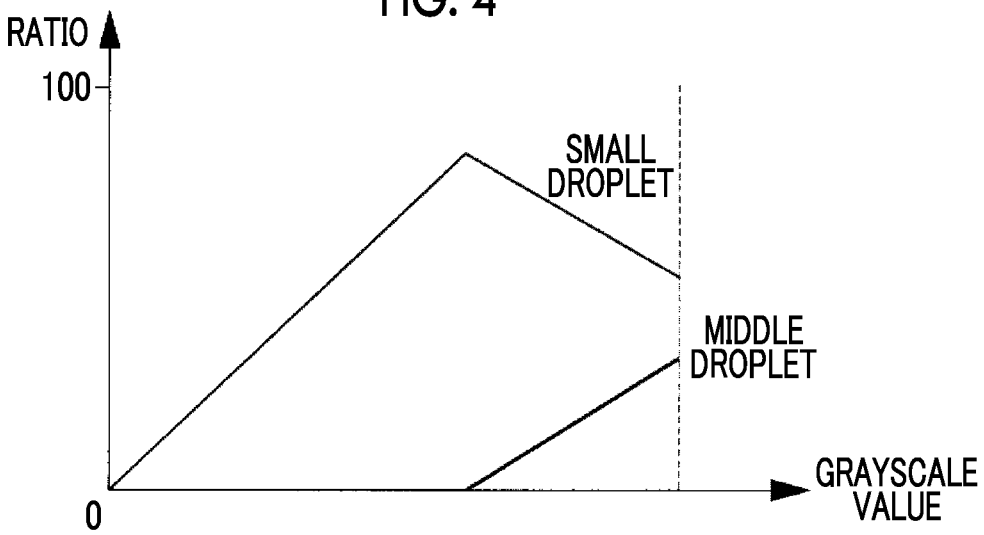
FIG. 4 is a diagram schematically illustrating usage ratios of a small drop and a medium drop to a grayscale value in an image recording device according to a preferable embodiment of the invention.

FIG. 4 is a diagram schematically illustrating usage ratios of the small droplet and the medium droplet to a grayscale value. In a low grayscale value region (low concentration region), the small droplet is used from the viewpoint of graininess. After the small droplet reaches a certain frequency, the medium droplet is mixed, and the ratio of the small droplet is reduced. Thus, it is possible to bury white between pixels, to thereby express the concentration. It is not essential that a grayscale value where the medium droplet starts being mixed or a grayscale value where the small droplet is reduced, the ratio of the small droplet at the moment, the ratio between the medium droplet and the small droplet at the maximum concentration, and the like are set as shown in FIG. 4. An optimal design is performed according to the impact density, the ink concentration, the droplet amounts of the small droplet and the medium droplet.

Then, a relationship between the size of the droplet and a discharge period of the droplet will be described.

Figure 5:
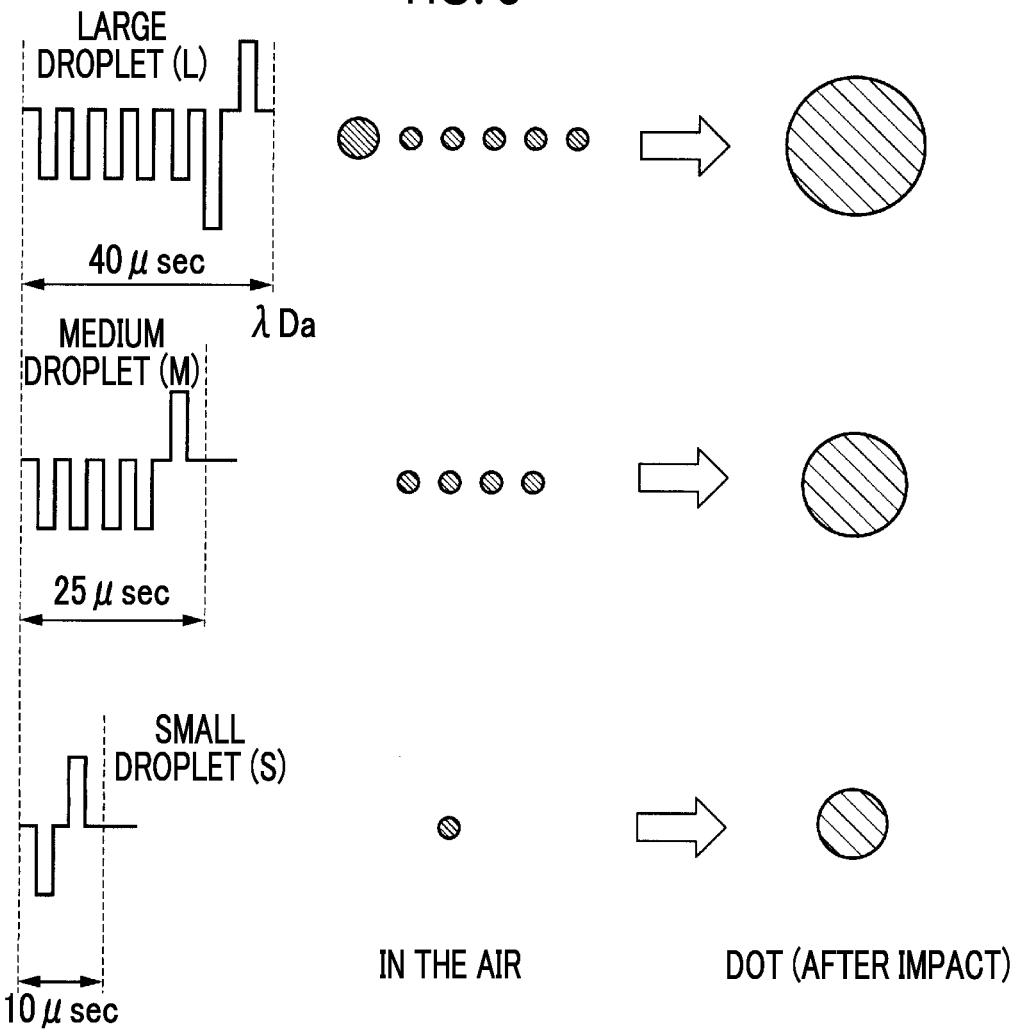
FIG. 5 is a schematic diagram illustrating a drive waveform of an ink jet image recording head of an image recording device according to a preferable embodiment of the invention.

FIG. 5 shows a schematic diagram of drive waveforms of the image recording heads 138 of the embodiment. Drive waveforms are shown on the left side of FIG. 5, droplet states in the air are shown at the center thereof, and dot states of droplets after impact are shown on the right side thereof. Here, the length (time) of a waveform necessary for discharge of a dot of one droplet is referred to as a necessary discharge period.

In the case of the small droplet, it is sufficient if one small droplet is discharged in the air in this example, and the necessary discharge period is short. In the case of the medium droplet, since four small droplets are discharged in the air in this example, the necessary discharge period becomes longer than that in the small droplet. In the case of the large droplet, since five small droplets are discharged in the air and one large droplet is finally discharged, the necessary discharge period becomes longer than that in the medium droplet. Generally, a droplet having a large dot size has a long waveform necessary for splashing one droplet. In FIG. 5, the necessary discharge period is 40 μsec in the case of the large droplet, 25 μsec in the case of the medium droplet, and 10 μsec in the case of the small droplet.

In FIG. 5, a configuration in which plural droplets are discharged and then are integrated during flying or impact to obtain recording of a medium droplet or a large droplet is shown, but a large droplet may be discharged at the time of discharge. In this case, similarly, a droplet having a large droplet amount has a waveform necessary for splashing one droplet, that is, a long necessary discharge period. Accordingly, a discharge period capable of discharging a droplet of the maximum dot size is rate-limited.

As described above, the large droplet is a droplet used only in a case where the discharge defect is corrected. Here, the necessary discharge period of the large droplet is represented as λDa, the necessary discharge period of the medium droplet (a droplet of the maximum dot size in normally used droplets) is represented as λD.

If the large droplet is used for correction of the discharge defect, the discharge period of the large droplet is rate-limited in a printing speed. That is, assuming that the image recording head 138 is configured by one head for each color and dots discharged from nozzles of the image recording head 138 are arranged with intervals of 1200 dpi, an upper limit of the printing speed becomes a value of 25400 μm/1200 dpi/40 μsec=0.529 dpi/μsec=529 mm/sec.

Here, in the case of one head, the printing speed is set to 500 mm/sec.

Figure 6:
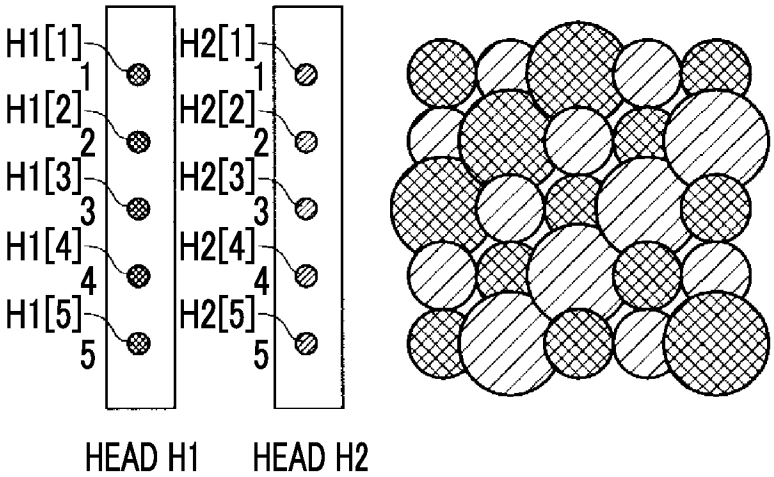
FIG. 6 is a diagram illustrating a configuration of ink jet type image recording heads and a normal discharge state thereof in an image recording device according to a preferable embodiment of the invention.

Next, the configuration of the image recording heads 138 of this embodiment and the state of the dots in the normal discharge are shown in FIG. 6. In this embodiment, for example, as the same ink jet image recording unit 138A for each color, two heads (a head H1 and a head H2) are provided. Thus, since a discharge duty of each head is reduced to ½, the printing speed may become at least double. In FIG. 6, hatchings of droplets from the head H1 and droplets from the head H2 are differently shown, but this is only a difference for distinguishing between dots discharged from the head H1 and dots discharged from the head H2 for ease of description, which are dots of the same color. Here, the number of the heads for each color is N (N=2 in the example of FIG. 6), and the heads are represented as H1, H2, . . . , HN, respectively.

Figure 7A:
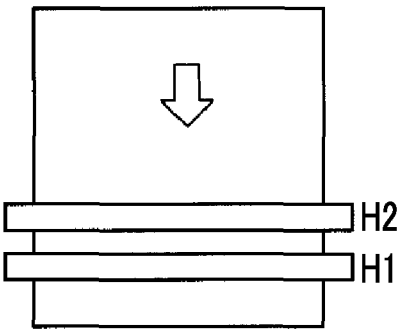
FIGS. 7A and 7B are diagrams illustrating a method in which an image is recorded by an image recording device according to a preferable embodiment of the invention.
Figure 7B:
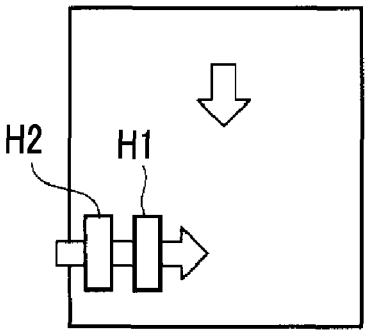

As an image recording method of this embodiment, printing is completed as the heads H1 and H2 relatively rotate only once on the recording medium (sheet 154). Specifically, a method in which an image is recorded as the sheet passes under the heads H1 and H2 having approximately the same width as that of the sheet, as shown in FIG. 7A, or a method in which an image is recorded as the heads H1 and H2 having a small width move in a sheet width direction, and then, the sheet moves by approximately the same distance as an image recording length of the heads H1 and H2, as shown in FIG. 7B, may be used.

Then, an image recording method in a case where there is a discharge defect nozzle in the image recording heads 138 (head H1 and head H2) of this embodiment will be described.

First, a method of recording an image using the image recording device 10 of this embodiment will be described.

Figure 8:
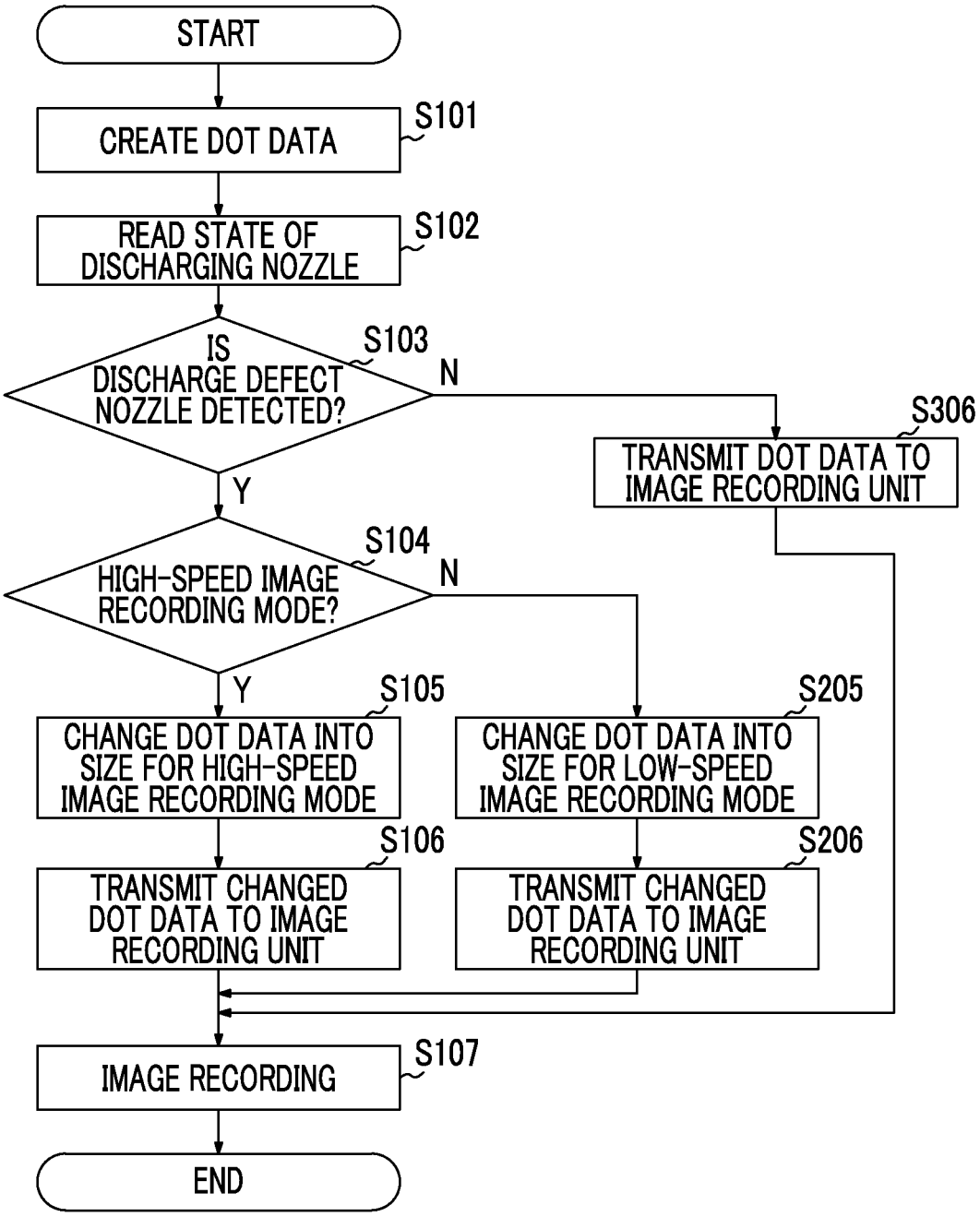
FIG. 8 is a flowchart illustrating an image recording method in an image recording device according to a preferable embodiment of the invention.

Referring to FIG. 8, first, the image processing unit 184 (see FIG. 3) converts an input image or the like into dot data configured by dots of two or more sizes (step S101).

Then, the discharge state reading unit 188 (see FIG. 3) reads a discharge state of the discharging nozzles of the image recording head 138 (head H1 and head H2) (step S102), and determines whether or not the discharge defect nozzle is defected based on data from the check image reading sensor 158 (see FIG. 3) (step S103).

If the discharge defect nozzle is not detected, the data transmitting unit 186 (see FIG. 3) transmits the dot data created in step S101 to the image recording heads 138 (head H1 and head H2) of the image recording unit 118 (see FIG. 1) without a change (step S306), and the image is recorded on the sheet 154 (see FIG. 1) by the image recording heads 138 (head H1 and head H2) (step S107).

In a case where the discharge defect nozzle is detected, the control unit 180 (see FIGS. 3A and 3B) determines whether a currently selected image recording mode is the high-speed image recording mode (step S104).

In a case where the currently selected image recording mode is the high-speed image recording mode, the dot data changing unit 185 (see FIG. 3) changes the dot data created in step S101 into dot data for the high-speed image recording mode (step S105). Further, the data transmitting unit 186 (see FIG. 3) transmits the changed dot data into the image recording heads 138 (head H1 and head H2) of the image recording unit 118 (see FIG. 1) (step S106). In the image recording heads 138 (head H1 and head H2), an image is recorded on the sheet 154 (see FIG. 1) based on the changed dot data (step S107).

In a case where the currently selected image recording mode is not the high-speed image recording mode, the dot data changing unit 185 (see FIG. 3) changes the dot data created in step S101 into dot data for the low-speed image recording mode (step S205). Further, the data transmitting unit 186 (see FIG. 3) transmits the changed dot data into the image recording heads 138 (head H1 and head H2) of the image recording unit 118 (see FIG. 1) (step S206). In the image recording heads 138 (head H1 and head H2), an image is recorded on the sheet 154 (see FIG. 1) based on the changed dot data (step S107).

Then, a change of the dot data in the high-speed image recording mode will be described. In the high-speed image recording mode, a discharge defect is corrected without using a large droplet in correction.

Figure 9A:
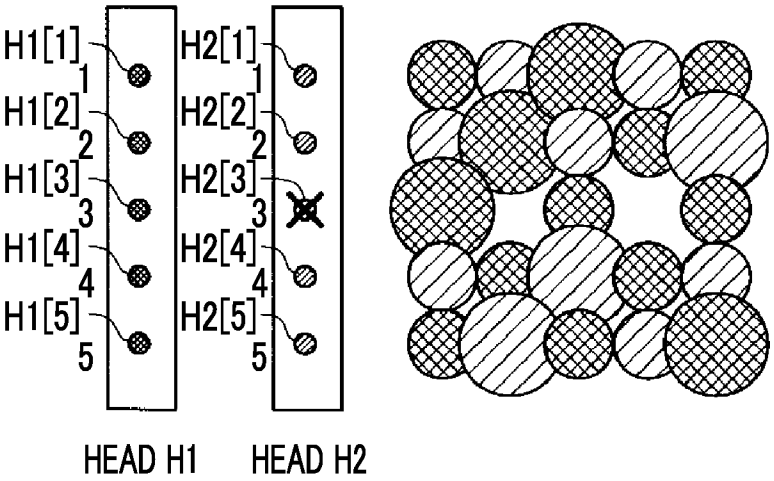
FIG. 9A is a diagram illustrating an image recorded in a case where a part of image recording heads of an image recording device according to a preferable embodiment of the invention is in a non-discharge state.
Figure 9B:
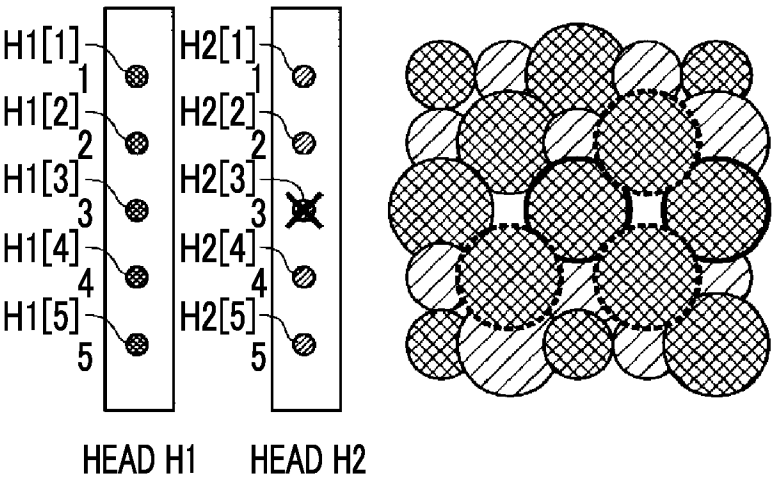
FIG. 9B is a diagram illustrating an image after correction in a high-speed image recording mode.

FIG. 9A shows a state of dots in a case where a third nozzle 3 (referred to as H2[3]) from the top of the head H2 is in a non-discharge state and dot data is not changed. FIG. 9B shows a state of dots in a state where the third same nozzle 3 (referred to as H2[3]) from the top of the head H2 is in the non-discharge state and the dot data is changed. Here, if heads are denoted as Hn (n=1, 2, . . . , N), since two heads are provided for each color in this embodiment, N becomes 2. Further, a discharge defect nozzle is denoted as HI[J]. Then, in this embodiment, the head H1 includes nozzles H1[1] to H1[5], and the head H2 includes nozzles H2[1] to H2[5]. Since I is 2 and J is 3, a non-discharging nozzle is denoted as a nozzle H2[3].

When changing dot data, first, a small droplet from the nozzle 3 (H1[3]) of the head H1 capable of impacting the same position in a nozzle column direction, with respect to the nozzle 3 (H2[3]) of the head H2 which is a non-discharging nozzle, is changed into a medium droplet to be discharged (see thick solid lines shown in FIG. 9B).

Further, a part of small droplets from the nozzle 2 (H1[2]) and the nozzle 4 (H1[4]) of the head H1, which are adjacent to the nozzle 3 (H1[3]) of the head H1, are changed into medium droplets to be discharged (see thick solid lines shown in FIG. 9B).

Figure 10B:
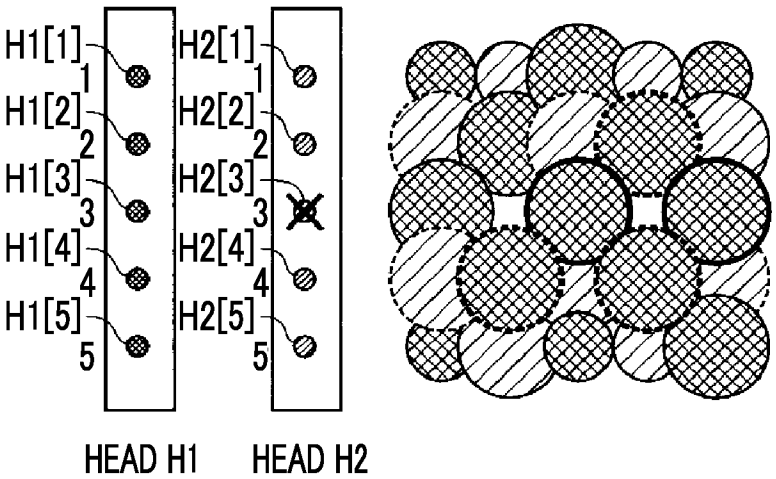
FIGS. 10A and 10B are diagrams illustrating an image after correction in a high-speed image recording mode in a case where a part of image recording heads of an image recording device according to a preferable embodiment of the invention is in a non-discharge state.
Figure 10A:
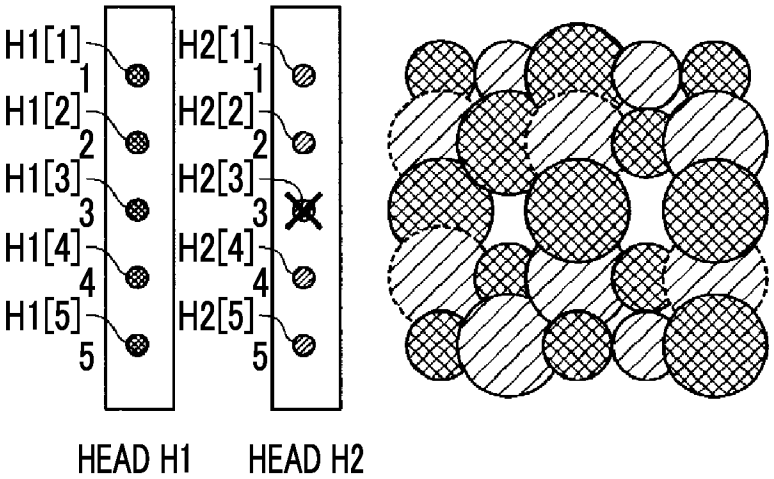

In FIG. 9B, the droplets discharged from the nozzle 2 (H1[2]) and the nozzle 4 (H1[4]) of the head H1, which are adjacent to the nozzle 3 (H1[3]) of the head H1, are changed into medium droplets, but as shown in FIG. 10A, droplets discharged from the nozzle 2 (H2[2]) and the nozzle 4 (H2[4]) of the head H2, which are adjacent to the nozzle 3 (H2[3]) of the head H2, may be changed into medium droplets. Here, as shown in FIG. 10B, with respect to a pixel to be impacted by the nozzle 3 (H2[3]) of the head H2, the droplets discharged from the nozzle 2 (H1[2]) and the nozzle 4 (H1[4]) of the head H1 and the nozzle 2 (H2[2]) and the nozzle 4 (H2[4]) of the head H2 which are adjacent to each other in the nozzle column direction may be changed into medium droplets.

In this case, since the medium droplet has a maximum dot size, the printing speed is determined by a necessary discharge period of the medium droplet. Since two heads are provided, dots discharged from nozzles of each head are arranged with intervals of 1200/2=600 dpi, and thus, the printing speed is increased up to a value of 25400 μm/600 dpi/25 μsec=1.693 μm/μsec=1693 mm/sec.

In other words, the number of heads is two times, and the printing speed is about 3.2 times. Here, the printing speed in the high-speed mode is set to 1600 mm/sec. Here, in a case where a discharge period of each head in the high-speed image recording mode is represented as TH, the discharge period TH of nozzles of each head becomes a value of TH=25400 μm/600 dpi/1600 μm/μsec=about 26.5 μsec.

Figure 11:
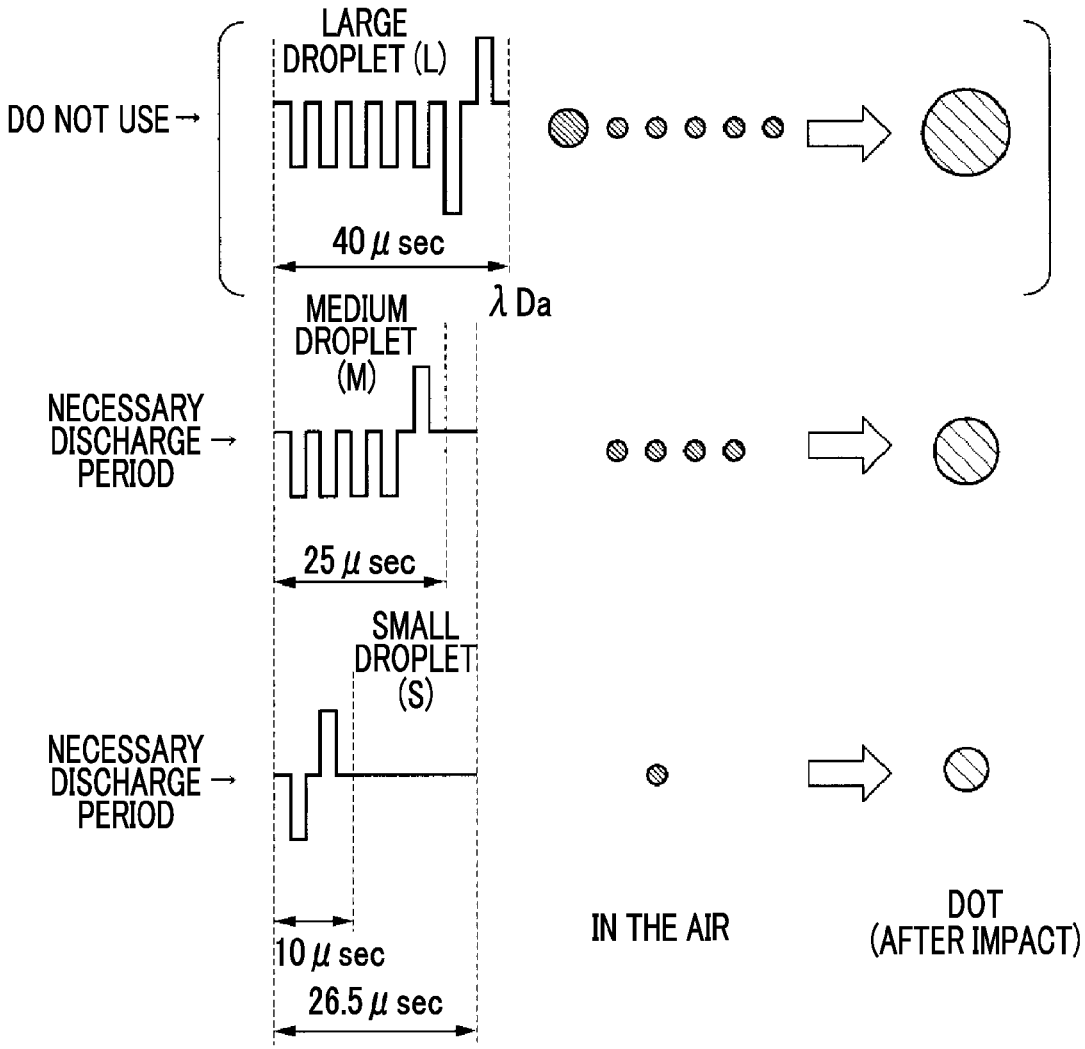
FIG. 11 is a schematic diagram illustrating a drive waveform of an image recording head of an image recording device according to a preferable embodiment of the invention, in a high-speed image recording mode.

Drive waveforms of the head at that time are as shown in FIG. 11.

Next, a change of the dot data in the low-speed image recording mode will be described. In the low-speed image recording mode, a discharge defect is corrected using a large droplet in correction. Since the correction is performed using the large droplet, high-quality image recording can be performed, but the image recording speed becomes slow.

Figure 12B:
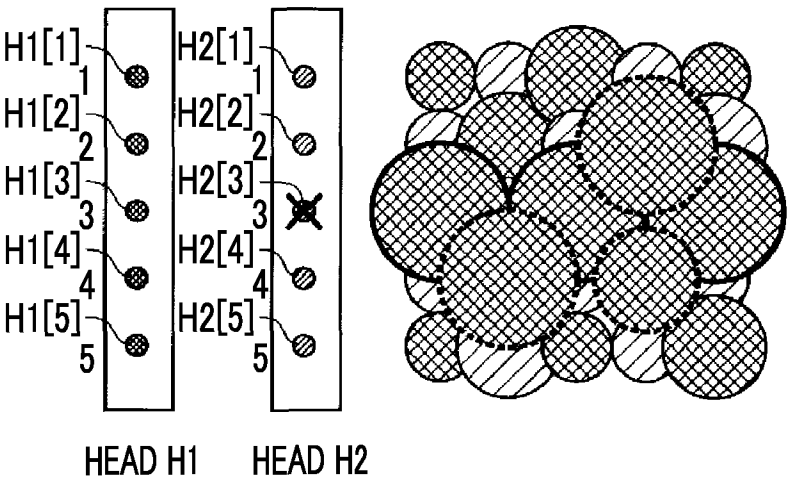
FIG. 12B is a diagram illustrating an image after correction in a low-speed image recording mode.
Figure 12A:
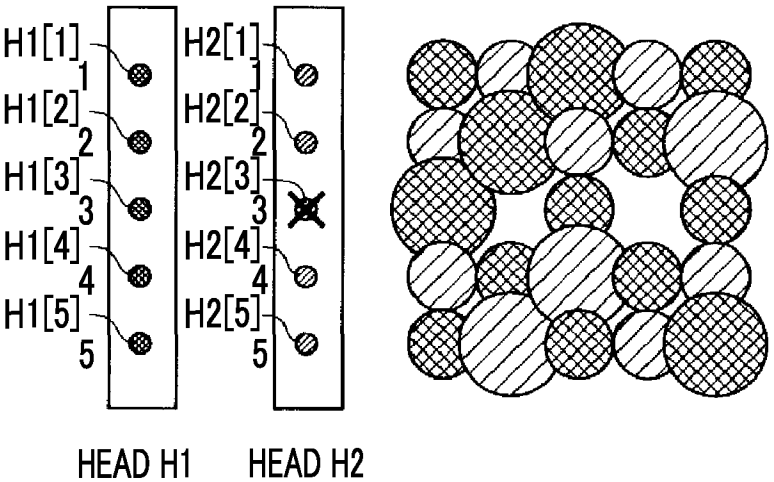
FIG. 12A is a diagram illustrating an image recorded in a case where a part of image recording heads of an image recording device according to a preferable embodiment of the invention is a non-discharge state.

FIG. 12A shows a state of dots in a case where a third nozzle 3 (referred to as H2[3]) from the top of the head H2 is in a non-discharge state and dot data is not changed. FIG. 12B shows a state of dots in a case where the third same nozzle 3 (referred to as H2[3]) from the top of the head H2 is in the non-discharge state and the dot data is changed.

When changing dot data, first, with respect to the nozzle 3 (H2[3]) of the head H2 which is in the non-discharge state, a small droplet from the nozzle 3 (H1[3]) of the head H1 capable of impacting the same position in the nozzle column direction is changed into a large droplet to be discharged (see thick solid lines shown in FIG. 12B).

Further, a part of small droplets from the nozzle 2 (H1[2]) and the nozzle 4 (H1[4]) of the head H1, which are adjacent to the nozzle 3 (H1[3]) of the head H1, are changed into medium droplets or large droplets to be discharged (see thick broken lines shown in FIG. 12B).

Figure 13B:
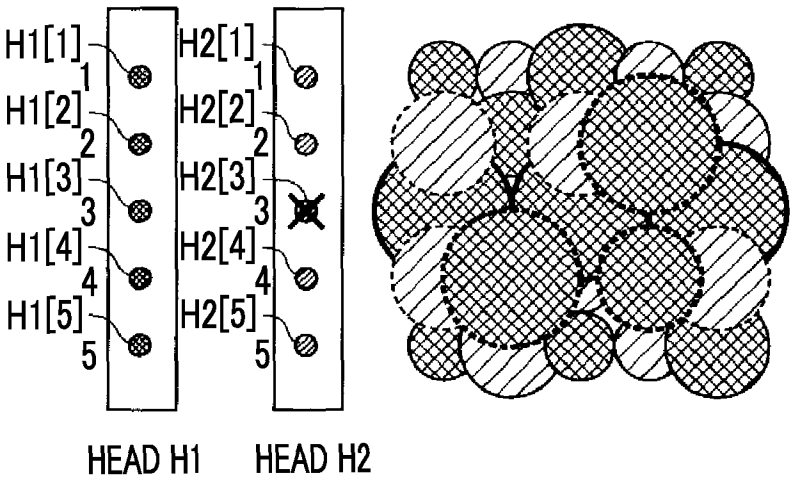
FIGS. 13A and 13B are diagrams illustrating an image after correction in a low-speed image recording mode in a case where a part of image recording heads of an image recording device according to a preferable embodiment of the invention is in a non-discharge state.
Figure 13A:
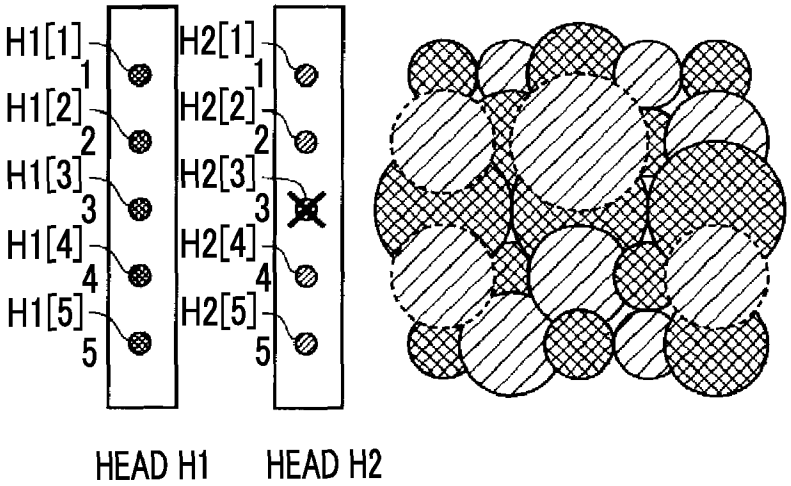

In FIG. 12), a part of the droplets discharged from the nozzle 2 (H1[2]) and the nozzle 4 (H1[4]) of the head H1, which are adjacent to the nozzle 3 (H1[3]) of the head H1, are changed into the medium droplets or the large droplets, but as shown in FIG. 13A, a part of droplets discharged from the nozzle 2 (H2[2]) and the nozzle 4 (H2[4]) of the head H2, which are adjacent to the nozzle 3 (H2[3]) of the head H2, may be changed into medium droplets or large droplets. Here, as shown in FIG. 13B, with respect to a pixel to be impacted by the nozzle 3 (H2[3]) of the head H2 which is in the non-discharge state, it is preferable that a part of the droplets discharged from the nozzle 2 (H1[2]) and the nozzle 4 (H1[4]) of the head H1 and the nozzle 2 (H2[2]) and the nozzle 4 (H2[4]) of the head H2 which are adjacent to each other in the nozzle column direction are changed into medium droplets instead of being changed into medium droplets or large droplets.

In this case, since the large droplet has a maximum dot size, the printing speed is determined by a necessary discharge period of the large droplet. Since two heads are provided, dots discharged from nozzles of each head are arranged at the interval of 1200/2=600 dpi, and thus, the printing speed is increased up to a value of 25400 μm/600 dpi/40 μsec=1.058 μm/μsec=1058 mm/sec.

In other words, the number of heads is two times, and the printing speed is about two times. Here, the printing speed in the low-speed (high-quality) mode is set to 1000 mm/sec.

Here, in a case where a discharge period of each head in the low-speed (high-quality) image recording mode is represented TS, the discharge period TS of nozzles of each head becomes a value of TS=25400 μm/600 dpi/1000 μm/msec=about 42.3 μsec.

Figure 14:
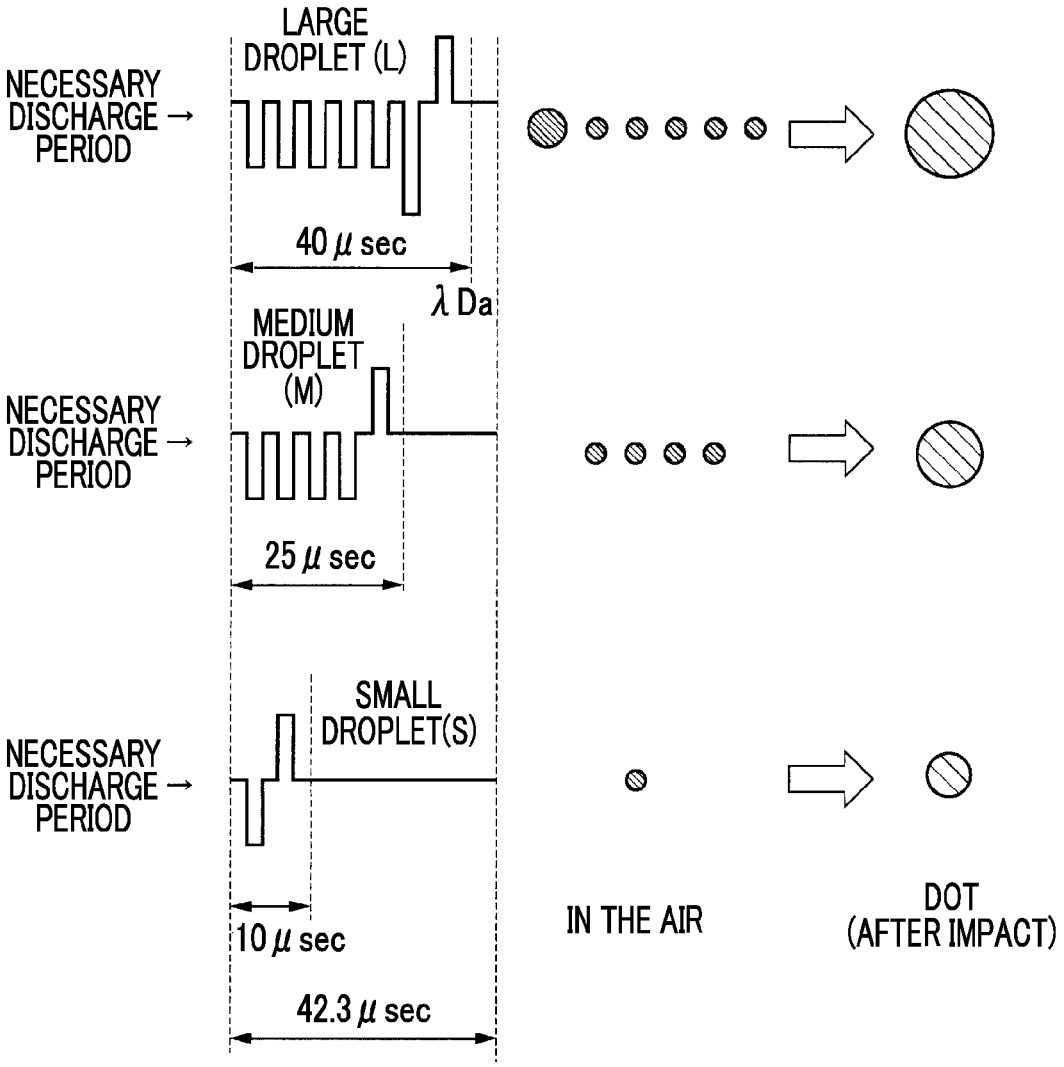
FIG. 14 is a schematic diagram illustrating a drive waveform of an ink jet image recording head of an image recording device according to a preferable embodiment of the invention, in a low-speed image recording mode.

Drive waveforms of the head at that time are as shown in FIG. 14.

Next, a change of dot data and a change of a droplet discharge timing in a case where two defect nozzles are arranged will be described. The change of the dot data is performed by the dot data changing unit 185, and the change of the droplet discharge timing is performed by the discharge timing control unit 189 (see FIG. 3B).

Figure 15:
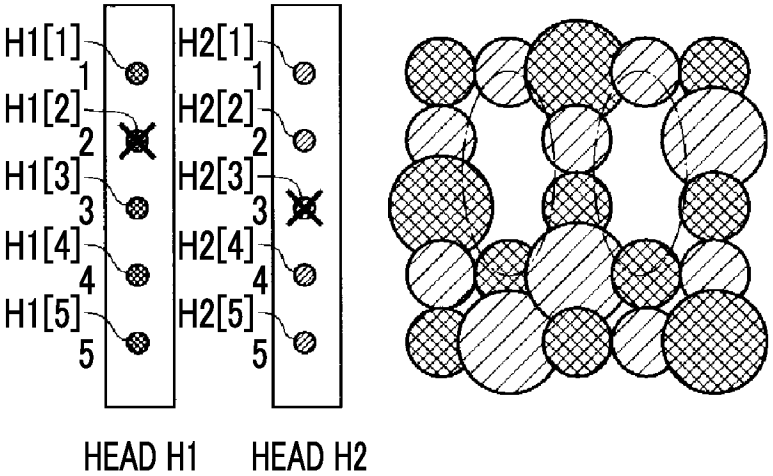
FIG. 15 is a diagram illustrating an image recorded in a case where a part of image recording heads of an image recording device according to a preferable embodiment of the invention is in a non-discharge state and image recording droplets for impacting consecutive positions are in a discharge defect state.

FIG. 15 shows a state of dots in a case where the nozzle 3 (H2[3]) of the head H2 and the nozzle 2 (H1[2]) of the head H1 are in a non-discharge state and dot data is not changed. Emptiness of dots occurs at position which are originally to be impacted by two dots (see single dot chain lines).

Figure 16B:
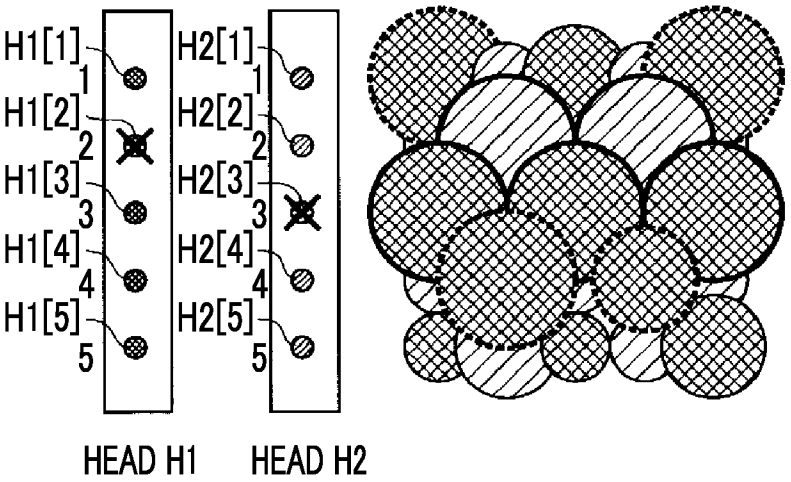
FIG. 16B is a diagram illustrating an image after correction in a high-speed image recording mode.
Figure 16A:
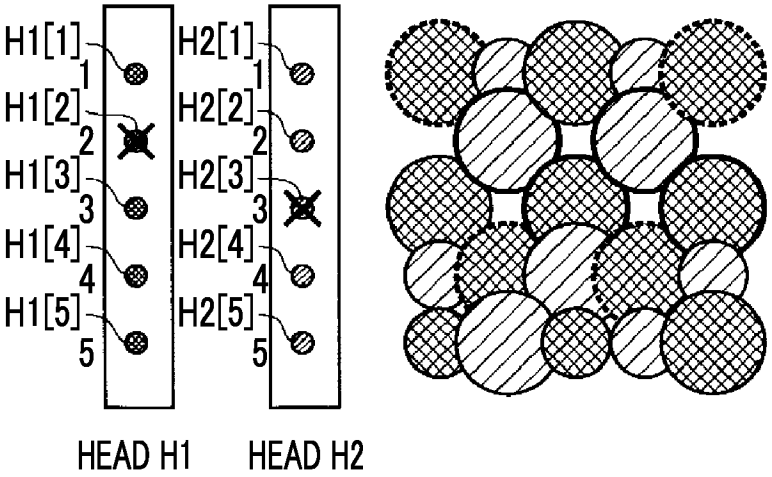
FIG. 16A is a diagram illustrating an image after correction in a case where a part of image recording heads of an image recording device according to a preferable embodiment of the invention is in a non-discharge state and image recording droplets for impacting consecutive positions are in a discharge defect state.

Referring to FIG. 16A, the change of the dot data and the change of the droplet discharge timing in the high-speed image recording mode will be described. First, with respect to the nozzle 3 (H2[3]) of the head H2 which is in the non-discharge state, a small droplet from the nozzle 3 (H1[3]) of the head H1 capable of impacting the same position in the nozzle column direction is changed into a medium droplet to be discharged, and with respect to the nozzle 2 (H1[2]) of the head H1 which is in the non-discharge state, a small droplet from the nozzle 2 (H2[2]) of the head H2 capable of impacting the same position in the nozzle column direction is changed into a medium droplet to be discharged. Further, a discharge position of the medium droplet from the nozzle 2 (H2[2]) shifts by one pixel with respect to a discharge position from the nozzle 3 (H1[3]) (see thick solid lines).

Figure 17:
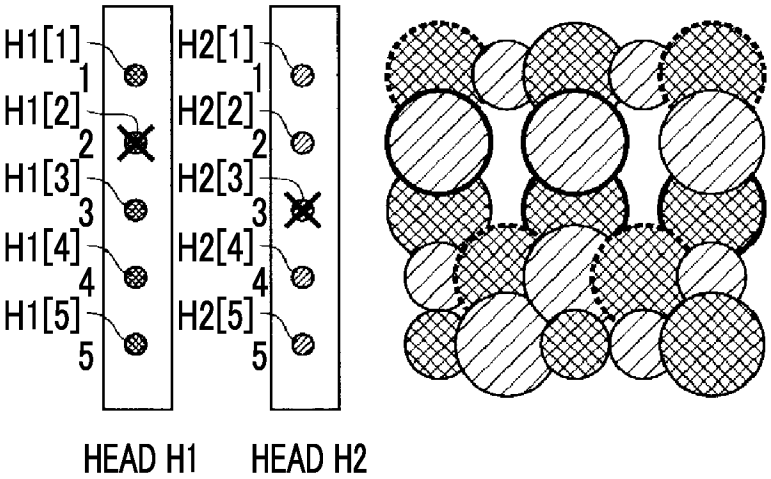
FIG. 17 is a diagram illustrating an image after correction performed without displacing a discharge timing of an image recording droplet, in a case where a part of image recording heads of an image recording device according to a preferable embodiment of the invention is in a non-discharge state and image recording droplets for impacting consecutive positions are in a discharge defect state, in a high-speed image recording mode.

FIG. 17 shows a case where droplets from the nozzle 2 (H2[2]) of the head H2 and the nozzle 3 (H1[3]) of the head H1 are changed into medium droplets and discharge positions do not shift by one pixel (see thick lines).

As shown in FIG. 17, in a case where the discharge positions do not shift by one pixel, empty regions which are not impacted by two consecutive dots occur. On the other hand, as shown in FIG. 16A, in a case where the discharge positions shift by one pixel, it is possible to reduce the empty regions which are not impacted by dots. A configuration in which the discharge position of the medium droplet from the nozzle 3 (H1[3]) shifts by one pixel with respect to the discharge position of the medium droplet from the nozzle 2 (H2[2]) may be used, instead of a configuration in which the discharge position of the medium droplet from the nozzle 2 (H2[2]) shifts by one pixel with respect to the discharge position of the medium droplet from the nozzle 3 (H1[3]).

Further, a part of small droplets from the nozzle 1 (H1[1]) and the nozzle 4 (H1[4]) of the head H1, which are adjacent to the nozzle 3 (H2[3]) of the head H2 which is in the non-discharge state and the nozzle 2 (H1[2]) of the head H1 which is in the non-discharge state, are changed into medium droplets to be discharged (see thick broken lines shown in FIG. 16A). A part of small droplets from the nozzle 1 (H2[1]) and the nozzle 4 (H2[4]) of the head H2, instead of the nozzle 1 (H1[1]) and the nozzle 4 (H1[4]) of the head H1, may be changed into medium droplets. Further, a part of small droplets from the nozzle 1 (H1[1]) and the nozzle 4 (H1[4]) of the head H1 and the nozzle 1 (H2[1]) and the nozzle 4 (H2[4]) of the head H2 may be changed into medium droplets to be discharged.

Next, referring to FIG. 16B, the change of the dot data and the change of the droplet discharge timing in the low-speed (high quality) image recording mode will be described. First, with respect to the nozzle 3 (H2[3]) of the head H2 which is in the non-discharge state, a small droplet from the nozzle 3 (H1[3]) of the head H1 capable of impacting the same position in the nozzle column direction is changed into a large droplet to be discharged, and with respect to the nozzle 2 (H1[2]) of the head H1 which is in the non-discharge state, a small droplet from the nozzle 2 (H2[2]) of the head H2 capable of impacting the same position in the nozzle column direction is changed into a large droplet to be discharged (see thick solid lines). Further, a discharge position of the large droplet from the nozzle 2 (H2[2]) shifts by one pixel with respect to a discharge position from the nozzle 3 (H1[3]) (see thick solid lines). By shifting the discharge positions by one pixel, it is possible to reduce emptiness of the dots. Instead of a configuration in which the discharge position of the large droplet from the nozzle 2 (H2[2]) shifts by one pixel, a configuration in which a discharge position of the large droplet from the nozzle 3 (H1[3]) shifts by one pixel may be used.

Further, a part of small droplets from the nozzle 1 (H1[1]) and the nozzle 4 (H1[4]) of the head H1, which are adjacent to the nozzle 3 (H2[3]) of the head H2 which is in the non-discharge state and the nozzle 2 (H1[2]) of the head H1 which is in the non-discharge state, are changed into medium droplets or large droplets to be discharged (see thick broken shown in FIG. 16B). A part of small droplets from the nozzle 1 (H2[1]) and the nozzle 4 (H2[4]) of the head H2, instead of the nozzle 1 (H1[1]) and the nozzle 4 (H1[4]) of the head H1, may be changed into small droplets or large droplets to be discharged. Further, a part of small droplets from the nozzle 1 (H1[1]) and the nozzle 4 (H1[4]) of the head H1 and the nozzle 1 (H2[1]) and the nozzle 4 (H2[4]) of the head H2 may be changed into medium droplets or large droplets to be discharged.

Figure 18:
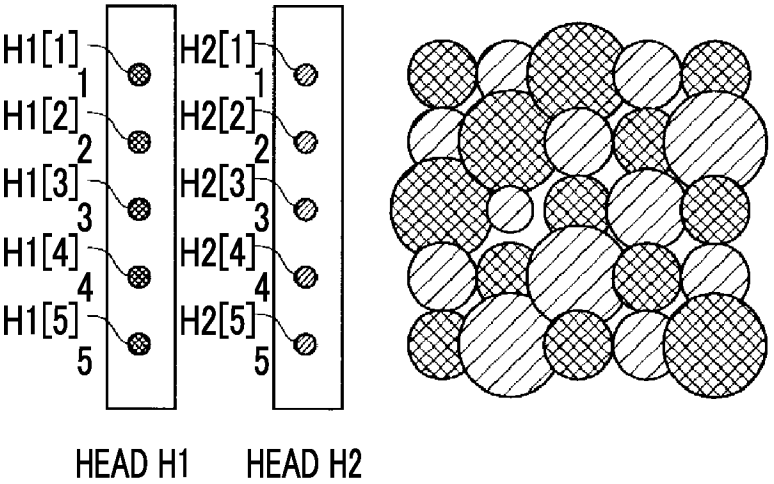
FIG. 18 is a diagram illustrating an image recorded in a case where dot sizes of image recording droplets discharged from a part of image recording heads of an image recording device according to a preferable embodiment of the invention are small.
Figure 19:
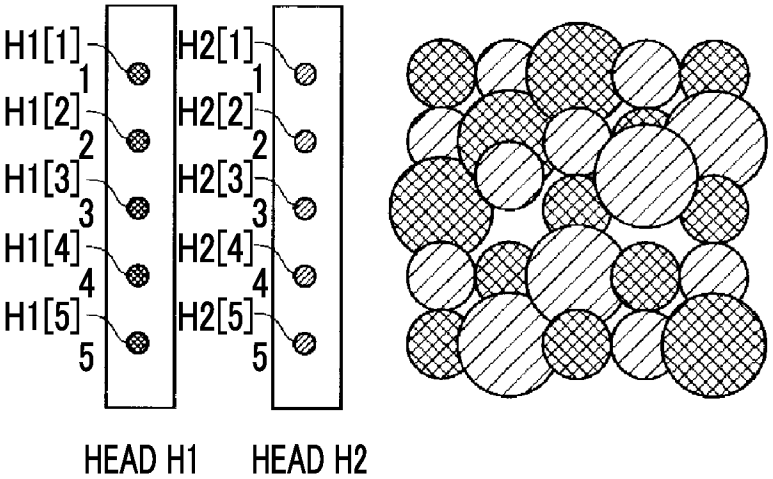
FIG. 19 is a diagram illustrating an image recorded in a case where impact positions of image recording droplets discharged from a part of image recording heads of an image recording device according to a preferable embodiment of the invention are displaced from impact positions in a case where nozzles are in a normal state.

Hereinbefore, the correction in a case where the nozzles are in the non-discharge state is described, but as shown in FIG. 18, in a case where the dot size of a droplet for impact is smaller than that in a normal case (in a case where the dot size of the droplet from the nozzle 3 (H2[3]) of the head H2 is small), the above-described correction method may be applied. Further, as shown in FIG. 19, in a case where an impact position of a droplet shifts from an impact position in a normal case (in a case where an impact position of the droplet from the nozzle 3 (H2[3]) of the head H2 shifts in a direction of the nozzle 2 (H2[2])), the above-described correction method may be applied.

Further, in a case where the dot size of the droplet is small or in a case where the impact position of the droplet shifts, a discharge operation of such a defect nozzle is stopped (or the defect nozzle is considered as a non-discharging nozzle), and the above-described correction method may be applied.

Hereinabove, the preferred embodiments have been described, but the above-described preferred embodiments are only examples. An image recording device according to a first aspect which is a generalized form of the preferred embodiments includes: an image recording unit that includes plural sets (N (≥2)) of image recording heads (in which the respective heads are represented as H1, H2, . . . , HN) in which each head includes the same number (M (≥2)) of plural discharging nozzles that discharge an image recording droplet; an image processing unit that converts an input image into dot data configured by dots of two or more sizes (in which the dots of two or more sizes are represented as Dot-1, Dot-2, . . . , Dot-D in an ascending order); a data transmitting unit that transmits the dot data from the image processing unit to the image recording unit; an image recording mode control unit that controls the image recording unit so that an image is recorded in at least two image recording modes where image recording speeds are different from each other; a discharge state reading unit that reads discharge states of plural discharging nozzles; and a dot data change unit that changes, if the discharge state reading unit detects a discharge defect of one (J-th) discharging nozzle (HI[J]) among plural (M) discharging nozzles of one (I-th) image recording head HI among the plural image recording heads (H1, H2, HN), a dot size of an image recording droplet discharged from a J-th discharging nozzle (HK[J]) of an image recording head HK (K-th head (K is 1, 2, . . . , N, which is other than I)) other than the image recording head HI including the discharging nozzle (HI[J]) into a size (Dot-da (d<da≤D)) larger than a dot size (Dot-d (1≤d≤D)) of an image recording droplet to be discharged from the discharging nozzle (HI[J]) in a case where an image is recorded in a first mode (high-speed image recording mode) where an image recording speed is fast, and changes the dot size of the image recording droplet discharged from the discharging nozzle (HK[J]) into a size (Dot-Da) which is larger than the largest dot size (Dot-D) among the dot sizes in a case where the image is recorded in a second mode (low-speed image recording mode) where the image recording speed is slower than that in the first mode.

In the image recording speed, a discharge period of an image recording droplet having a maximum dot size is rate-limited, but in the first mode (high-speed image recording mode) where the image recording speed is fast, since the correction is performed by an image recording droplet of a size within dots of two or more sizes, it is possible to correct image quality without lowering the image recording speed. Further, in the second mode (low-speed image recording mode) where the image recording speed is slower than that in the first mode, since the correction is performed by the dot size (Dot-Da) larger than the largest dot size (Dot-D) among dots of two or more sizes, although the image recording speed becomes slower than that in the first mode, it is possible to obtain a high quality image (it is possible to reduce visibility of streaky irregularities by the correction). In this way, in the image recording device of the first aspect which is the generalized form of the preferred embodiments, it is possible to select a printing speed and image quality (reduction in visibility of streaky irregularities due to correction).

In an image recording device according to a second aspect which is a generalized form of the preferred embodiments, in the image recording device according to the first aspect, in a case where a necessary discharge period of a waveform for creating an image recording droplet of the dot size (Dot-Da) which is larger than the largest dot size among dots of two or more sizes is represented as λDa, a necessary discharge period of a waveform for creating an image recording droplet of the largest dot size (Dot-D) is represented as λD, a discharge time interval of the respective discharging nozzles in the first mode (high-speed image recording mode) where the image recording speed is fast is represented as TH, and a discharge time interval of the respective discharging nozzles in the second mode (low-speed image recording mode) where the image recording speed is slow is represented as TS, the necessary discharge period λDa, the necessary discharge period λD, the discharge time interval TH and the discharge time interval TS are in an inequality relationship of TS>λDa>TH>λD.

With this configuration, it is possible to appropriately set the image recording speed in the first mode (high-speed image recording mode) where the image recording speed is fast.

In an image recording device according to a third aspect which is a generalized form of the preferred embodiments, in the image recording device of the first aspect or the second aspect, in a case where the image is recorded in the first mode (high-speed image recording mode) where the image recording speed is fast, the dot data change unit changes a dot size of an image recording droplet discharged from at least one discharging nozzle among a (J−1)-th discharging nozzle (HI[J]) and a (J+1)-th discharging nozzle (HI[J+1]) of the image recording head HI having the discharging nozzle (HI[J]) into the large size (Dot-D).

With this configuration, it is possible to reliably perform discharge defect correction.

In an image recording device according to a fourth aspect which is a generalized form of the preferred embodiments, in the image recording device of the first aspect or the second aspect, in a case where the image is recorded in the second mode (low-speed image recording mode) where the image recording speed is slow, the dot data change unit changes at least one of dot sizes of image recording droplets discharged from a (J−1)-th discharging nozzle (HI[J−1]) and a (J+1)-th discharging nozzle (HI[J+1]) of the image recording head HI having the discharging nozzle (HI[J]) into a size which is equal to or smaller than the dot size (Dot-Da) larger than the largest dot size (Dot-D).

With this configuration, it is possible to reliably perform discharge defect correction.

In an image recording device according to a fifth aspect which is a generalized form of the preferred embodiments, the image recording device according to any one of the first to fourth aspects further includes: a discharge timing control unit that controls timings when the image recording droplets are respectively discharged from the plural discharging nozzles of the plural image recording heads, in which in a case where the one (J-th) discharging nozzle (HI[J]) among the plural (M) discharging nozzles of the one (I-th) image recording head HI among the plural image recording heads (H1, H2, HN) and one ((J−1)-th or (J+1)-th) discharging nozzle ((Hi[J−1]) or (Hi[J+1])) among plural (M) discharging nozzles of one image recording head Hi (i is one of 1, 2, . . . , N, and also includes I) among the plural image recording heads (H1, H2, HN), which discharges an image recording droplet for impacting a position consecutive to a position to be impacted by an image recording droplet to be discharged from the discharging nozzle (HI[J]), are in a discharge defect state, the discharge timing control unit performs a control for shifting a discharge timing of a normal discharging nozzle capable of allowing an image recording droplet to impact the position to be impacted by the image recording droplet to be discharged from the discharging nozzle (HI[J]) and a position to be impacted by an image recording droplet to be discharged from the discharging nozzle (at least one of (Hi[J−1]) and (Hi[J+1])) from an original discharge timing to a discharge timing in a case where the discharging nozzle (HI [J]) and the discharging nozzle ((Hi[J−1]) or (Hi[J+1])) are not in the discharge defect state.

With this configuration, in a case where dots for impacting positions which are consecutive in the nozzle column direction are in a discharge defect state, by changing discharge timings of normal discharging nozzles capable of discharging dots for impacting the same positions as in discharge defect nozzles in the nozzle column direction, it is possible to reliably perform discharge defect correction.

Hereinabove, various typical embodiments of the invention have been described, but the invention is not limited to the embodiments. Accordingly, a technical scope of the invention is defined by only claims.

What is claimed is:

1. An image recording device comprising:

an image recording unit that includes a plurality of image recording heads in which each head includes the same number of a plurality of discharging nozzles that discharge an image recording droplet;

an image processing unit that converts an input image into dot data configured by dots of two or more sizes;

a data transmitting unit that transmits the dot data from the image processing unit to the image recording unit;

an image recording mode control unit that controls the image recording unit so that an image is recorded in at least two image recording modes where image recording speeds are different from each other;

a discharge state reading unit that reads discharge states of the plurality of discharging nozzles; and a dot data change unit that changes, when the discharge state reading unit detects a discharge defect of a first discharging nozzle which is a J-th discharging nozzle among the plurality of discharging nozzles of one image recording head among the plurality of image recording heads, a dot size of an image recording droplet discharged from a second discharging nozzle which is a J-th discharging nozzle of at least one image recording head other than the image recording head including the first discharging nozzle to a first size larger than a dot size of an original image recording droplet to be discharged from the first discharging nozzle in a case where an image is recorded in a first mode where an image recording speed is fast among the image recording modes, and changes the dot size of the image recording droplet discharged from the second discharging nozzle to a second size which is larger than the largest dot size among the dot sizes in a case where the image is recorded in a second mode where the image recording speed is slower than that in the first mode among the image recording modes.

2. The image recording device according to claim 1, wherein where a period of a waveform for creating an image recording droplet of the second size is represented as λDa, a period of a waveform for creating an image recording droplet of the largest dot size is represented as λD, a discharge time interval of the first and second discharging nozzles in the first mode where the image recording speed is fast is represented as TH, and a discharge time interval of the first and second discharging nozzles in the second mode where the image recording speed is slow is represented as TS, the period λDa, the period λD, the discharge time interval TH and the discharge time interval TS are in a relationship of TS>λDa>TH>λD.

3. The image recording device according to claim 1, wherein in a case where the image is recorded in the first mode, the dot data change unit changes a dot size of an image recording droplet discharged from at least one of a third discharging nozzle which is a (J−1)-th discharging nozzle and a fourth discharging nozzle which is a (J+1)-th discharging nozzle of the image recording head having the first discharging nozzle to the first size.

4. The image recording device according to claim 1, wherein in the case where the image is recorded in the second mode, the dot data change unit changes at least one of dot sizes of image recording droplets discharged from a third discharging nozzle which is a (J−1)-th discharging nozzle and a fourth discharging nozzle which is a (J+1)-th discharging nozzle of the image recording head having the first discharging nozzle to a dot size which is equal to or smaller than the second dot size.

5. The image recording device according to claim 1, further comprising:

a discharge timing control unit that controls timings when the image recording droplets are discharged from the plurality of discharging nozzles, wherein in a case where the first discharging nozzle and a fifth discharging nozzle which is a (J−1)-th or (J+1)-th discharging nozzle among a plurality of discharging nozzles of one image recording head among the plurality of image recording heads, which discharges an image recording droplet for impacting a position consecutive to a position to be impacted by an image recording droplet to be discharged from the first discharging nozzle, are in a discharge defect state, the discharge timing control unit performs a control for shifting a discharge timing of a sixth discharging nozzle capable of allowing an image recording droplet to impact positions to be impacted by image recording droplets to be discharged from the first discharging nozzle and the fifth discharging nozzle from an original discharge timing to a discharge timing in a case where the first discharging nozzle and the fifth discharging nozzle are not in the discharge defect state.

* * * * *